US008117878B1

(12) United States Patent
Popiolkowski et al.

(10) Patent No.: US 8,117,878 B1
(45) Date of Patent: Feb. 21, 2012

(54) METHOD AND APPARATUS FOR FORMING AND TEXTURING PROCESS SHIELDS

(75) Inventors: Alan R. Popiolkowski, Los Banos, CA (US); Shannon M. Hart, Campbell, CA (US)

(73) Assignee: Novellus System, Inc., San Jose, CA (US)

( * ) Notice: Subject to any disclaimer, the term of this patent is extended or adjusted under 35 U.S.C. 154(b) by 827 days.

(21) Appl. No.: 12/191,882

(22) Filed: Aug. 14, 2008

Related U.S. Application Data

(60) Provisional application No. 60/965,243, filed on Aug. 17, 2007.

(51) Int. Cl.
*B21B 27/00* (2006.01)

(52) U.S. Cl. ..... 72/102; 72/82; 72/85; 72/370.05; 72/370.08

(58) Field of Classification Search ..... 72/82, 83, 72/84, 85, 102, 120, 316, 317, 318, 344, 72/370.01, 370.05, 370.07, 370.08, 393
See application file for complete search history.

(56) References Cited

U.S. PATENT DOCUMENTS

| | | | | |
|---|---|---|---|---|
| 354,568 | A * | 12/1886 | Norton et al. | 72/353.6 |
| 2,089,476 | A * | 8/1937 | Grotnes | 72/393 |
| 3,857,666 | A * | 12/1974 | Barnett | 425/393 |
| 3,967,488 | A * | 7/1976 | Hasselbeck et al. | 72/91 |
| 4,723,430 | A * | 2/1988 | Hahn | 72/54 |
| 6,812,471 | B2 | 11/2004 | Popiolkowski et al. | |
| 6,933,508 | B2 | 8/2005 | Popiolkowski et al. | |
| 6,983,632 | B2 * | 1/2006 | Mayfield | 72/84 |
| 7,004,000 | B2 * | 2/2006 | Campo et al. | 72/94 |
| 7,762,114 | B2 * | 7/2010 | Abney et al. | 72/84 |
| 2007/0059460 | A1 | 3/2007 | Abney et al. | |

* cited by examiner

*Primary Examiner* — Edward Tolan
(74) *Attorney, Agent, or Firm* — Okamoto & Benedicto LLP

(57) ABSTRACT

A textured process shield and similar parts may be formed and textured in the same forming process using a mandrel. The mandrel may have movable portions that may be set into a forming die position to form and texture a workpiece into a process shield and collapsed to allow the process shield to be removed from the mandrel. The movable portions may include several textured shoes supported by movable jaws. The movable portions may also include a contact surface having angled indentations.

17 Claims, 10 Drawing Sheets

METHOD AND APPARATUS FOR FORMING AND TEXTURING PROCESS SHIELDS

REFERENCE TO RELATED APPLICATION

This application claims the benefit of U.S. Provisional Application No. 60/965,243, filed on Aug. 17, 2007, entitled "Method and Apparatus for Forming and Texturing Process Shields," by Alan Popiolkowski and Shannon Hart, which is incorporated herein by reference in its entirety.

BACKGROUND OF THE INVENTION

1. Field of the Invention

The present invention relates generally to metal forming, and more particularly but not exclusively to methods and apparatus for forming and texturing process shields employed in semiconductor processing equipment.

2. Description of the Background Art

Various types of process shields are employed in semiconductor processing equipment. For example, in a physical vapor deposition (PVD) system, process shields are employed to collect materials that fail to deposit on a wafer being processed.

Conventional techniques for manufacturing process shields include metal spinning and use of twin wire arc spray. Deep drawing and hydroforming are two other processes capable of making tubular type parts, such as a process shields. However, deep drawing and hydroforming are not economically feasible with low volume production due to the high cost of associated tooling. Twin wire arc spray is also not desirable because it adds to the cost of manufacturing the shield, is inconsistent as it is predominantly a manual process, and is subject to separation and particle generation due to the sheet like film that builds up during wafer processing.

SUMMARY

A textured process shield and similar parts may be formed and textured in the same forming process using a mandrel. The mandrel may have movable portions that may be set into a forming die to form a workpiece into a process shield and collapsed to allow the process shield to be removed from the mandrel.

In one embodiment, the movable portions comprise several textured shoes supported by movable jaws. The jaws may be actuated to lock into forming die position to allow forming and texturing of the work piece and then collapsed to allow removal of the resulting process shield.

In another embodiment, the movable portions comprise movable tapered jaws. A tapered plug may be positioned within the mandrel to actuate the tapered jaws. The tapered jaws may have a contact surface comprising angled indentations that are at an angle relative to a normal plane of the contact surface. The tapered jaws may be locked into forming die position to allow forming and texturing of a workpiece and then collapsed to allow removal of the resulting process shield.

These and other features of the present invention will be readily apparent to persons of ordinary skill in the art upon reading the entirety of this disclosure, which includes the accompanying drawings and claims.

The use of the same reference label in different drawings indicates the same or like components. The drawings are not to scale.

DETAILED DESCRIPTION

In the present disclosure, numerous specific details are provided, such as examples of apparatus, components, and methods, to provide a thorough understanding of embodiments of the invention. Persons of ordinary skill in the art will recognize, however, that the invention can be practiced without one or more of the specific details. In other instances, well-known details are not shown or described to avoid obscuring aspects of the invention.

Figure 1:
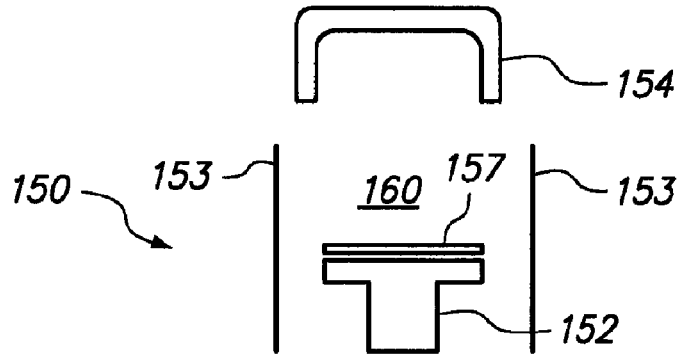
FIG. 1 schematically shows a PVD system in accordance with an embodiment of the present invention.

FIG. 1 schematically shows a PVD system 150 in accordance with an embodiment of the present invention. The PVD system 150 includes a pedestal 152 supporting a substrate 157 (e.g., semiconductor wafer) to be coated with target material from a target 154. The PVD system 150 may comprise a hollow cathode magnetron, for example. In that example, the target 154 is a hollow cathode target. As can be appreciated, the process shield and methods and apparatus for fabricating same disclosed herein are applicable to other semiconductor processing equipment, including other types of PVD systems.

The PVD system 150 includes a textured process shield 153 inside the vacuum chamber 160. The textured process shield 153 may have a tubular shape concentric with the pedestal 152. The textured process shield 153 surrounds the substrate 157 to collect target materials that miss the substrate 157. The textured process shield 153 is so named because of the texturing on its inner diameter surface, which faces towards the substrate 157. The texturing advantageously prevents sheet-like build up of materials that may eventually crack and cause particle contamination inside the chamber 160.

Figure 2:
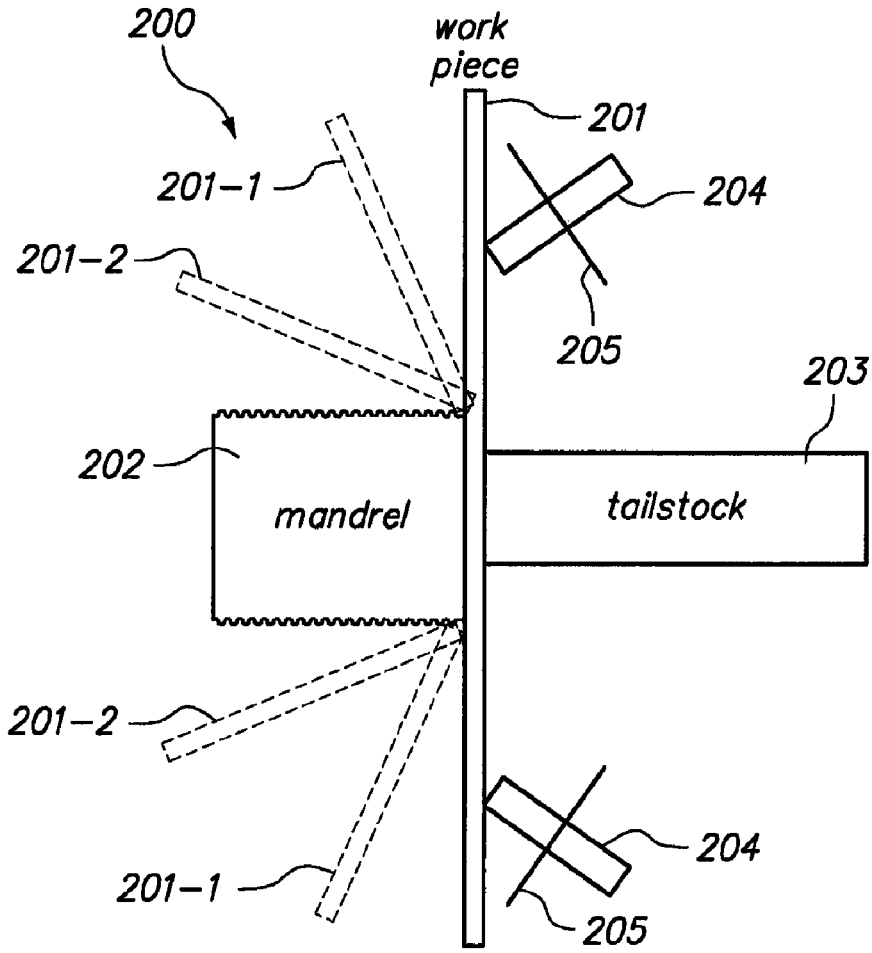
FIG. 2 schematically shows a metal forming system in accordance with an embodiment of the present invention.

FIG. 2 schematically shows a metal forming system 200 in accordance with an embodiment of the present invention. In the example of FIG. 2, the system 200 includes a mandrel 202, a tailstock 203, and rollers 204. Each roller 204 may have an outside diameter with a radius equal to approximately half it thickness Each roller 204 rolls about a centerline 205. The work piece 201 may comprise a material to be formed into a process shield 153 (see FIG. 1). The work piece 201 may comprise a circular die, water jet, plasma or laser cut pre-form made from sheet or plate stock. For example, the work piece 201 may comprise aluminum having a diameter of about 33 inches. Other materials may also be used. The material of work piece 201 preferably has enough ductility to allow the mandrel 202 to be expanded into the work piece 201 for removal, as later explained. The mandrel 202 may be hydraulically, pneumatically or mechanically actuated to expand and collapse.

In operation, the tailstock 203 clamps the work piece 201 to the mandrel 202. Thereafter, the mandrel 202 and work piece 201 are rotated while the rollers 204 are moved to push the work piece 201 towards the mandrel 202 to conform the shape of the work piece 201 to that of the mandrel 202. The dashed outlines 201-1 and 201-2 schematically illustrate the bending of the work piece 201 towards the mandrel 202 during this phase of the forming process.

The rollers 204 impinge on the rotating work piece 201 and traverse down the length of the mandrel 202, causing the work piece 201 to lay in intimate contact with the textured shoes of the mandrel 202. This causes the inside diameter of the work piece 201 to take on the male/female features that exist on the shoes of the mandrel 202. Any subsequent outside diameter texturing on the resulting tubular part that is needed at this point may be applied with an appropriate textured roller. Once the forming and texturing of the work piece 201 is completed, the mandrel 202 is actuated to collapse, allowing the resulting formed tubular, bucket-shaped part to be stripped from the mandrel 202, without having to take apart or cut away portions of the formed part. The formed part may be used as a single-piece textured process shield 153.

Figure 3C:
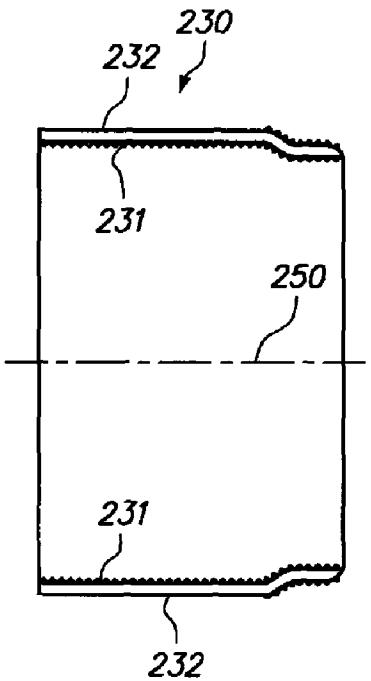
FIG. 3C shows a process shield formed using the mandrel of FIGS. 3A and 3B, in accordance with an embodiment of the present invention.
Figure 3B:
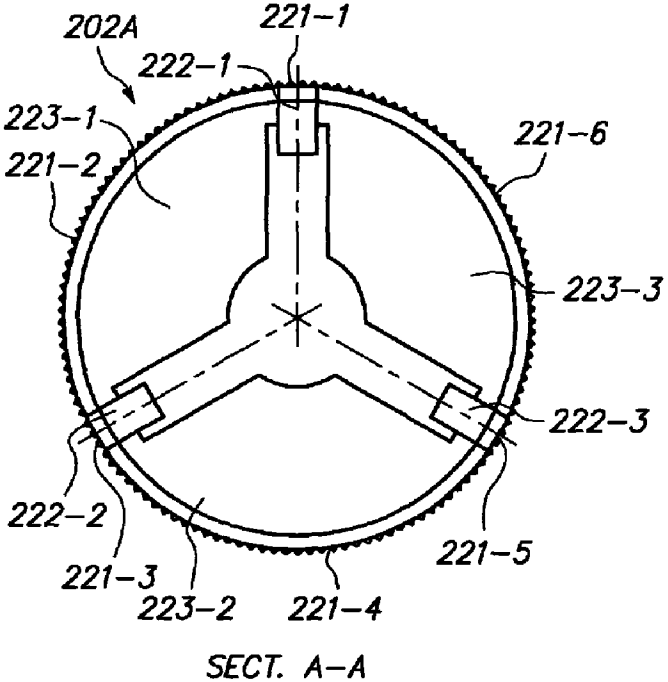
FIGS. 3A and 3B schematically show a mandrel in accordance with an embodiment of the present invention.
Figure 3A:
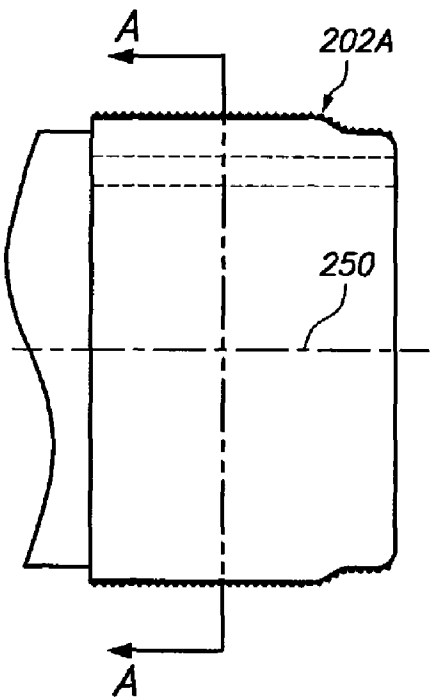

FIGS. 3A and 3B schematically show a mandrel 202A in accordance with an embodiment of the present invention. The mandrel 202A is a particular embodiment of the mandrel 202 of FIG. 2.

FIG. 3A shows a side view of the mandrel 202A. The mandrel 202A may have a tubular shape that is symmetric about a centerline 250.

FIG. 3B shows a cross-section of the mandrel 202A taken at section line A-A of FIG. 3A. As shown in FIG. 3B, the mandrel 202A may comprise six textured shoes 221 (i.e., 221-1, 221-2, 221-3, 221-4, 221-5, and 221-6), three primary jaws 223 (i.e., 223-1, 223-2, and 223-3), and three secondary jaws 222 (i.e., 222-1, 222-2, and 222-3). Note the separate shoe 221 for each jaw. In the example of FIG. 3A, shoe 221-1 is on the secondary jaw 222-1, shoe 221-2 is on the primary jaw 223-1, shoe 221-3 is on the secondary jaw 222-2, shoe 221-4 is on the primary jaw 223-2, shoe 221-5 is on the secondary jaw 222-3, and shoe 221-6 is on the primary jaw 223-3.

The textured shoes 221 may be detachable and interchangeable to allow different textures of different types to be used on the same mandrel 202A. As will be more apparent below, the jaws 222 and 223 are so named because they can be moved to expand and collapse the mandrel 202A. The mandrel 202A may be made of a relatively hard material. The textured shoes 221 may be formed by any suitable means including embossing, chemical etching or machining. The textured shoes 221 may comprise adjacent indentations each having an aspect ratio in the range of 1:01 to 1:2 where 1 is the diameter of the indentation and the 0.01 to 2 is the depth of the indentation.

FIG. 3C schematically shows a process shield 230 formed using the mandrel 202A, in accordance with an embodiment of the present invention. The process shield 230 is a particular embodiment of the process shield 153. The process shield 230 is tubular in this example, and symmetric about the centerline 250. The process shield 230 includes a textured surface 231 on the inner surface of its wall 232. The textured surface 231 faces a substrate in a processing chamber during normal operation.

Figure 4:
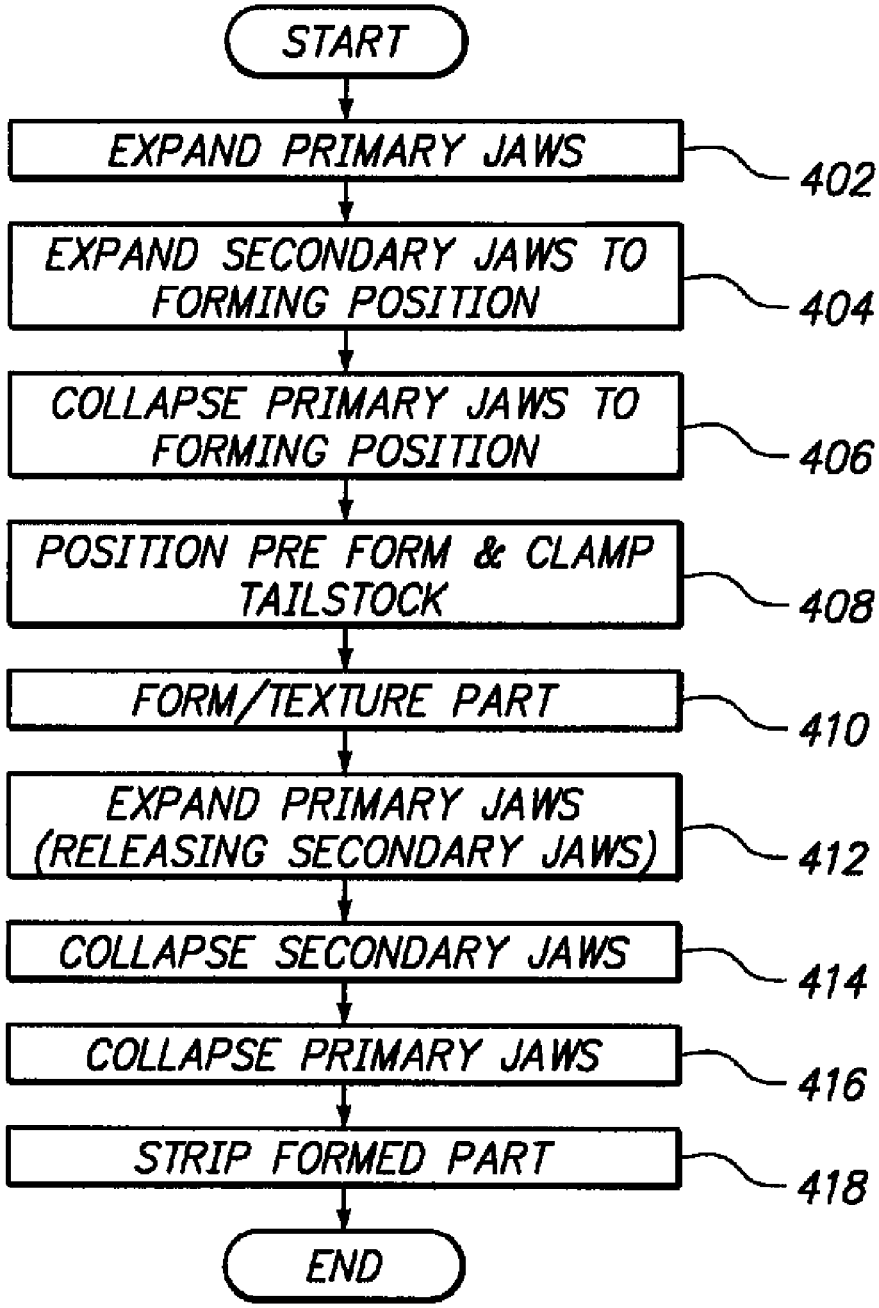
FIG. 4 shows a flow diagram of a method of operating a mandrel to form a process shield, in accordance with an embodiment of the present invention.

FIGS. 4 and 5A-5F illustrate the operation of the mandrel 202A to form a process shield in accordance with an embodiment of the present invention. FIG. 4 shows a flow diagram of a method 400 of operating the mandrel 202A while FIGS. 5A-5F provide corresponding schematic illustrations. FIGS. 5A-5F only show textured shoes 221-1, 221-2, and 221-6, primary jaws 223-1 and 223-3, and secondary jaw 222-1 for clarity of illustration. However, the illustrations apply to the rest of the mandrel 202A. In general, the three primary jaws 223 with their attached shoes 221 move in unison, and the three secondary jaws 222 with their attached shoes 221 move in unison. The primary jaws 223 and the secondary jaws 222 as sets, move independently of each other.

Figure 5A:
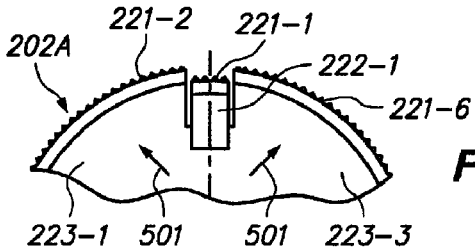
FIGS. 5A, 5B, 5C, 5D, 5E, and 5F provide graphical illustrations for the method of FIG. 4, in accordance with an embodiment of the present invention.
Figure 5B:
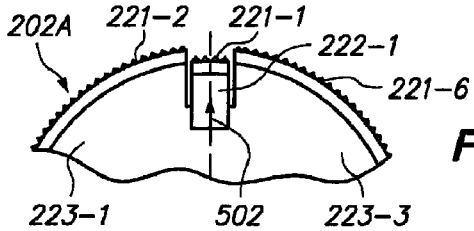
Figure 5C:
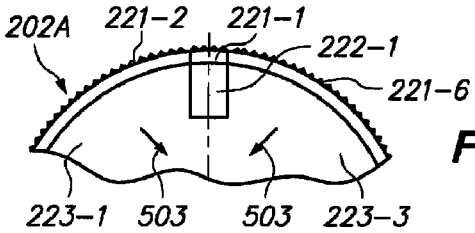
Figure 5D:
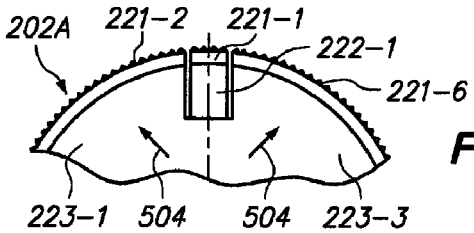
Figure 5E:
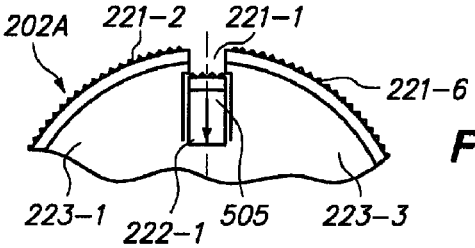
Figure 5F:
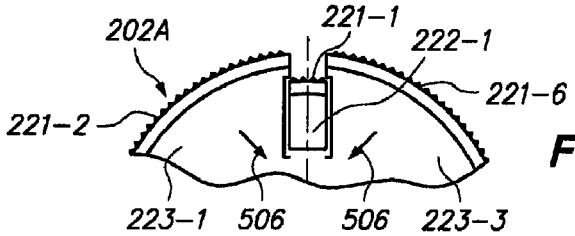

In preparation for the forming process, the primary jaws 223 are expanded to allow the secondary jaws 222 to move freely (FIG. 4, step 402; FIG. 5A, see arrows 501). The secondary jaws 222 are then moved up to a forming position with the primary jaws 223, creating a forming die (FIG. 4, step 404; FIG. 5B, see arrow 502). The primary jaws 223 are collapsed onto the secondary jaws 222 (FIG. 4, step 406; FIG. 5C, see arrows 503), locking the mandrel 202A to forming position. The work piece 201 (e.g., a pre-form) is then positioned with the mandrel 202A and clamped with the tailstock 203 (FIG. 4, step 408; see also FIG. 2). The work piece 201 is then formed and textured in the same forming process (FIG. 4, step 410) to create a tubular textured process shield ("formed part"). After the process shield is formed and textured, the primary jaws 223 are expanded to release the secondary jaws 222 while the process shield is in-situ (FIG. 4, step 412; FIG. 5D, see arrows 504). The primary jaws 223 are expanded within the elastic limit of the material of the work piece 201. This frees the secondary jaws 222. The secondary jaws 222 are then collapsed by retracting them back towards the center of the mandrel 202A into accommodating pockets (FIG. 4, step 414; FIG. 5E, see arrow 505). This allows the primary jaws 223 to collapse by retracting over the secondary jaws 222 (FIG. 4, step 416; FIG. 5F, see arrows 506), freeing the process shield. The process shield is then stripped from the mandrel 202A (FIG. 4, step 418).

Note that because of the novel design of the mandrel 202A, a single-piece process shield is formed and textured in the same forming process. The process shield can be removed from the mandrel after the forming process without having to take apart or otherwise cut away portions of the process shield.

As can be appreciated, the multiple shoes 221 of the mandrel 202A may be smooth or textured depending on the part being manufactured. The shoes 221 are textured in these examples to form a textured process shield. The mandrel 202A allows a process shield to be formed and textured in the same forming process, resulting in significant cost savings. Each shoe 221 may be actuated, e.g., pneumatically or hydraulically, using support shafts in the form of the primary jaws 223 and secondary jaws 222. The actuator mechanism may be used not just to support the shaft and shoes, but also to provide movement to enable stripping of the formed part from the mechanism.

Figure 6:
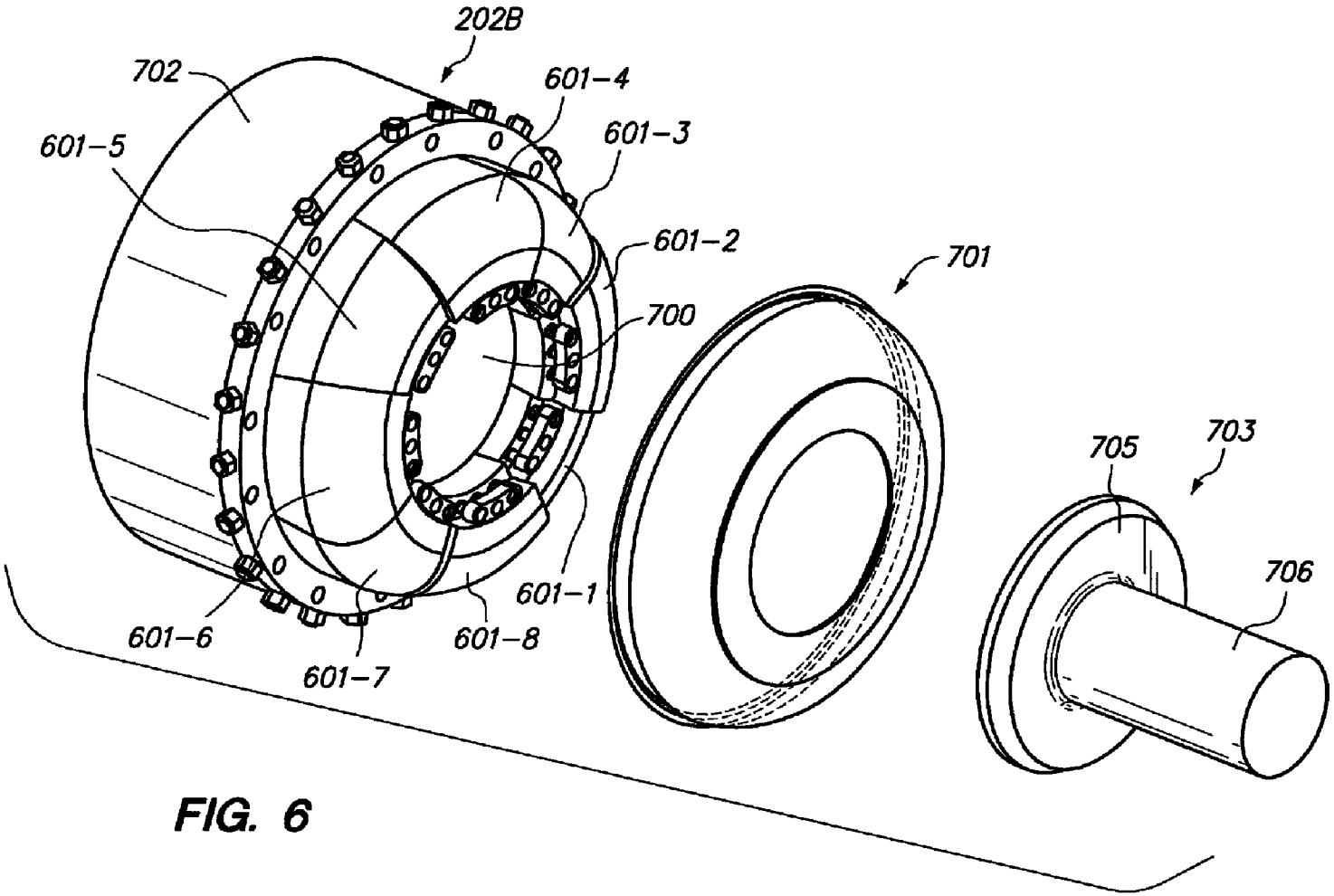
FIG. 6 schematically shows a mandrel in accordance with an embodiment of the present invention.

Referring now to FIG. 6, there is schematically shown a mandrel 202B in accordance with an embodiment of the present invention. The mandrel 202B is a particular embodiment of the mandrel 202 of FIG. 2.

Figure 7B:
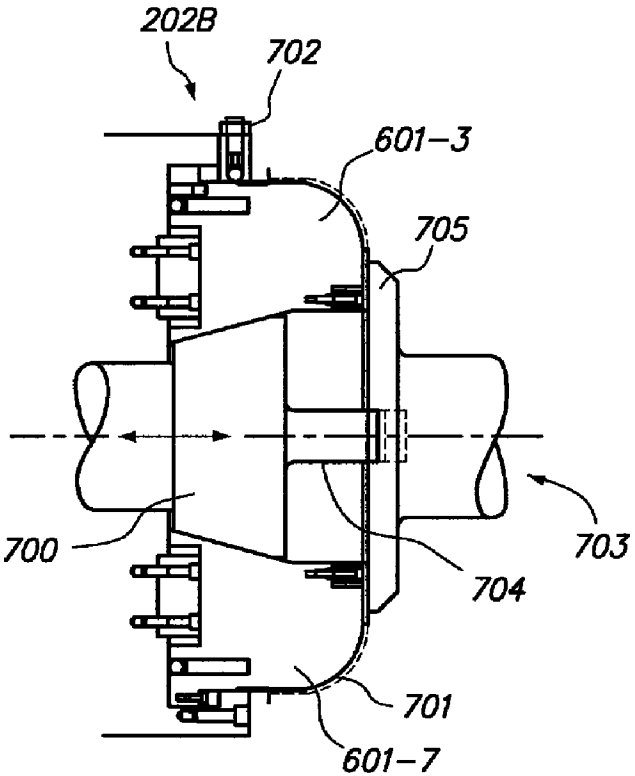
FIGS. 7A and 7B schematically show front and side cross-sectional views, respectively, of the mandrel of FIG. 6 in accordance with an embodiment of the present invention.

In the example of FIG. 6, the mandrel 202B includes a plurality of jaws 601 (i.e., 601-1, . . . , 601-8) and a main barrel 702. Note that the mandrel 202B also includes a tapered plug 700 as shown in FIG. 7B. There are eight jaws 601 in this example. The number of jaws 601 may vary depending on the application. The outer surface of the jaws 601 comprises a textured contact surface which pattern is transferred onto the workpiece during the forming process. FIG. 6 also shows a finished part in the form of a process shield 701 and a tailstock 703. In the example of FIG. 6, the tailstock 703 comprises a shaft 706 with a flanged clamp plate 705 that engages a spigot (see spigot 704 in FIG. 7B) during the forming process.

In one embodiment, the jaws 601 have tapered inside surfaces. Moving the tapered plug (see 700 in FIG. 7B) into the mandrel 202B expands the jaws 601 into forming die position. A hard stop may be used to limit the expansion of the jaws 601 with the plug positioned into the mandrel 202B. In preparation to the forming process, the mandrel 202B is locked into forming die position by pressing the tailstock 703 against the mandrel 202B with the workpiece in between. The mandrel 202B is then rotated while the workpiece is impinged on its surface, forming the workpiece into a process shield 701 with a textured inner surface as before. After the forming process, the plug 700 moves forward to disengage the mating tapered surface on the jaws 601, thereby collapsing the jaws 601 and allowing the process shield 701 to be stripped from the mandrel 202B without having to take apart or otherwise cut away portions of the process shield 701. This advantageously allows for a single-piece process shield made from a single piece of material, such as a pre-form comprising aluminum.

Figure 7A:
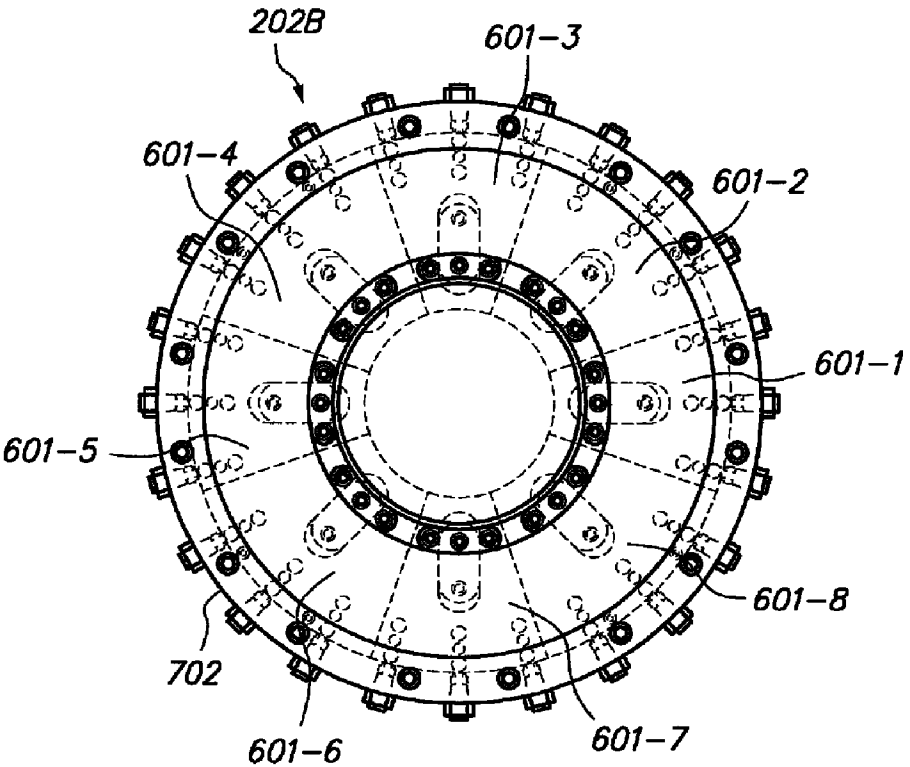

FIGS. 7A and 7B schematically show front and side cross-sectional views, respectively, of the mandrel 202B in accordance with an embodiment of the present invention. In the example of FIG. 7A, the mandrel 202B includes a set of primary jaws (labeled 601-2, 601-4, 601-6, and 601-8) and a set of secondary jaws (labeled 601-1, 601-3, 601-5, and 601-7). The primary jaws 601 are made bigger than the secondary jaws 601. The primary jaws 601 are configured such that as the plug 700 is retracted into the mandrel 202B, the primary jaws 601 expand to allow the secondary jaws 601 to move up. When the plug 700 is fully retracted into the mandrel 202B, the primary jaws 601 locks into forming die position with the secondary jaws 601.

FIG. 7B shows the mandrel 202B with the plug 700 retracted into the mandrel 202B in forming die position. FIG. 7B also shows the main barrel 702, the tapered inside surface of the jaws 601, and the corresponding tapered outside surface of the plug 700. A location spigot 704 engages the flanged clamp plate 705 of the tailstock 703. The plug 700 may be positioned within the mandrel 202B to a movement range of about 1.00 inch or less, for example.

Figure 8:
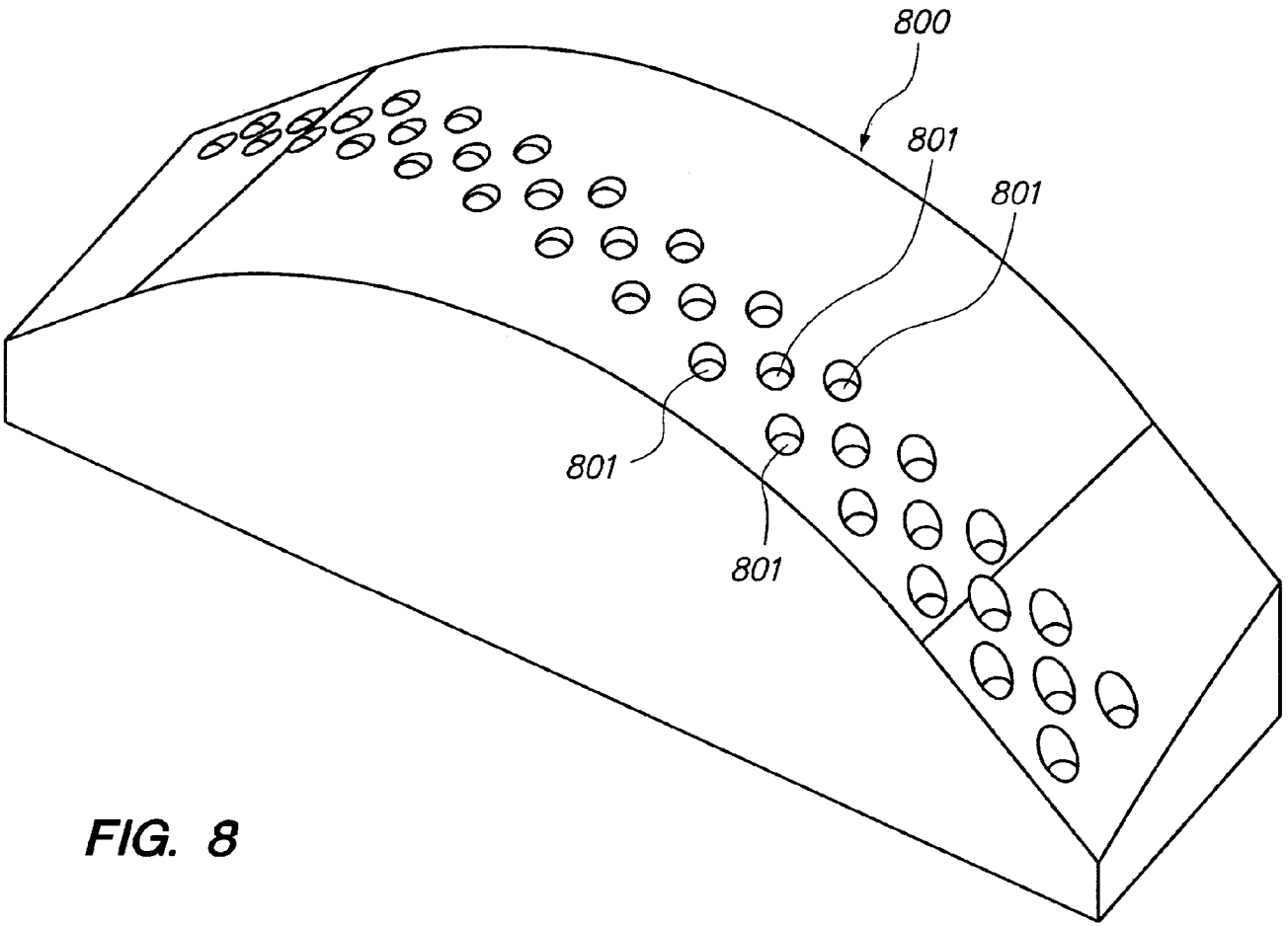
FIG. 8 shows a jaw contact surface in accordance with an embodiment of the present invention.

FIG. 8 shows a jaw section contact surface 800 in accordance with an embodiment of the present invention. The surface 800 may be used as the outer surface of the jaws 601 that contacts the workpiece being formed into a process shield.

In the example of FIG. 8, the jaw contact surface 800 includes a pattern having indentations 801. A workpiece contacting the indentations 801 will be imparted with an inverse pattern, which comprises angled dimples in this example. Only some of the indentations 801 have been labeled and shown for clarity of illustration.

In the example of FIG. 8, the indentations 801 are configured to impart angled dimples on the workpiece. That is, each indentation 801 comprises a hollow cavity formed at an angle (e.g., 45 degrees) relative to the axis of revolution of the mandrel. The indentations 801 are at an angle to allow for ease of removal of the resulting process shield. As can be appreciated, the angle of the indentations 801 relative to the normal plane may vary depending on where the indentations 801 are on the surface 800. For example, a group of indentations 801 in one location of the surface 800 may be at a 45 degree angle, while another group of indentations 801 at another location may be at another degree angle. The angle of the indentations 801 relative to the normal plane of the surface 800 may be optimized for a particular process shield, as different PVD systems may impart different trajectories to sputtered target material.

Figure 9A:
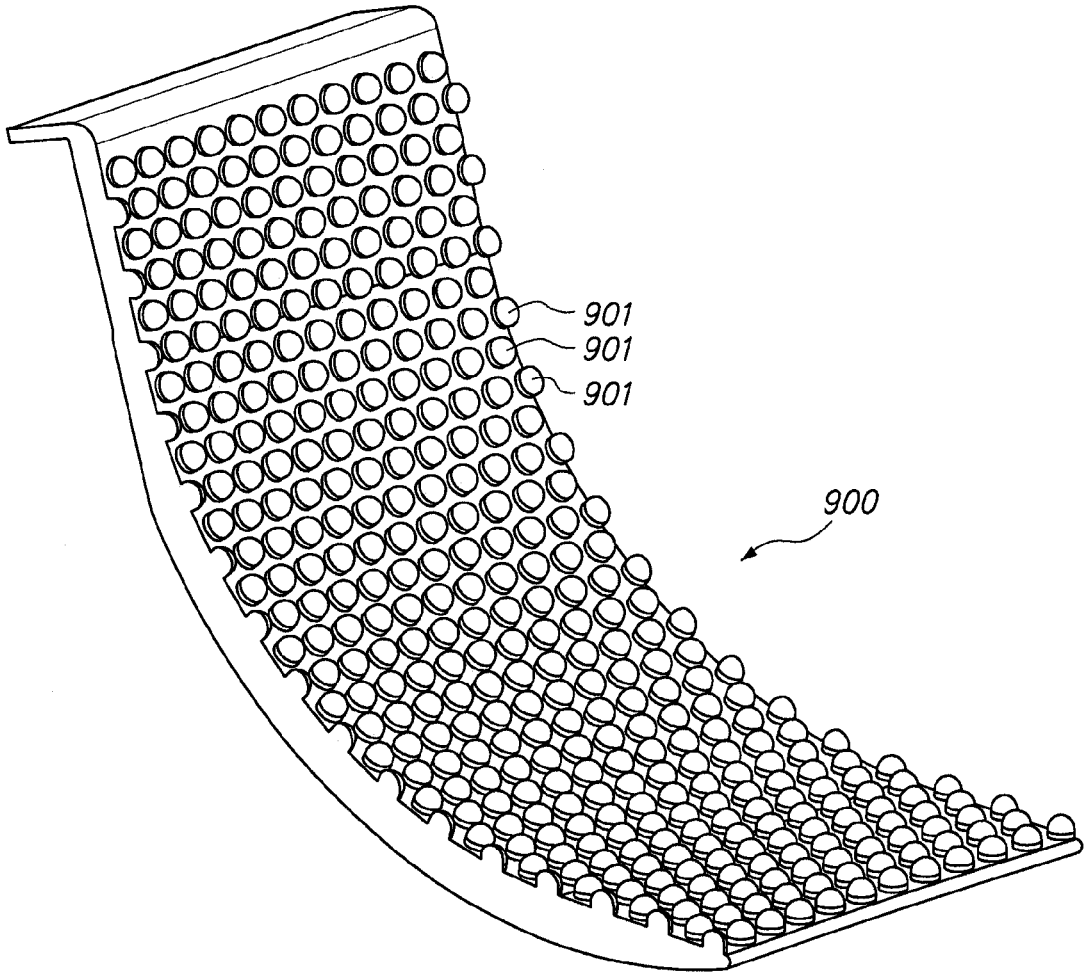
FIGS. 9A, 9B, and 9C show portions of process shields in accordance with embodiments of the present invention.

FIG. 9A shows a portion of a process shield 900 in accordance with an embodiment of the present invention. FIG. 9A shows the dimples 901 formed on the inner surface of the process shield 900. Only some of the dimples 901 are labeled for clarify of illustration.

In the example of FIG. 9A, each dimple 901 is at an angle of 90 degrees relative to the normal plane of the inner surface of the process shield 900. The dimples 901 may be imparted by a mandrel 202B having a textured pattern comprising indentations (e.g., indentations 801). The number and location of the dimples 901 may vary depending on the number and locations of corresponding indentations on the contact surface of the mandrel 202B.

Figure 9B:
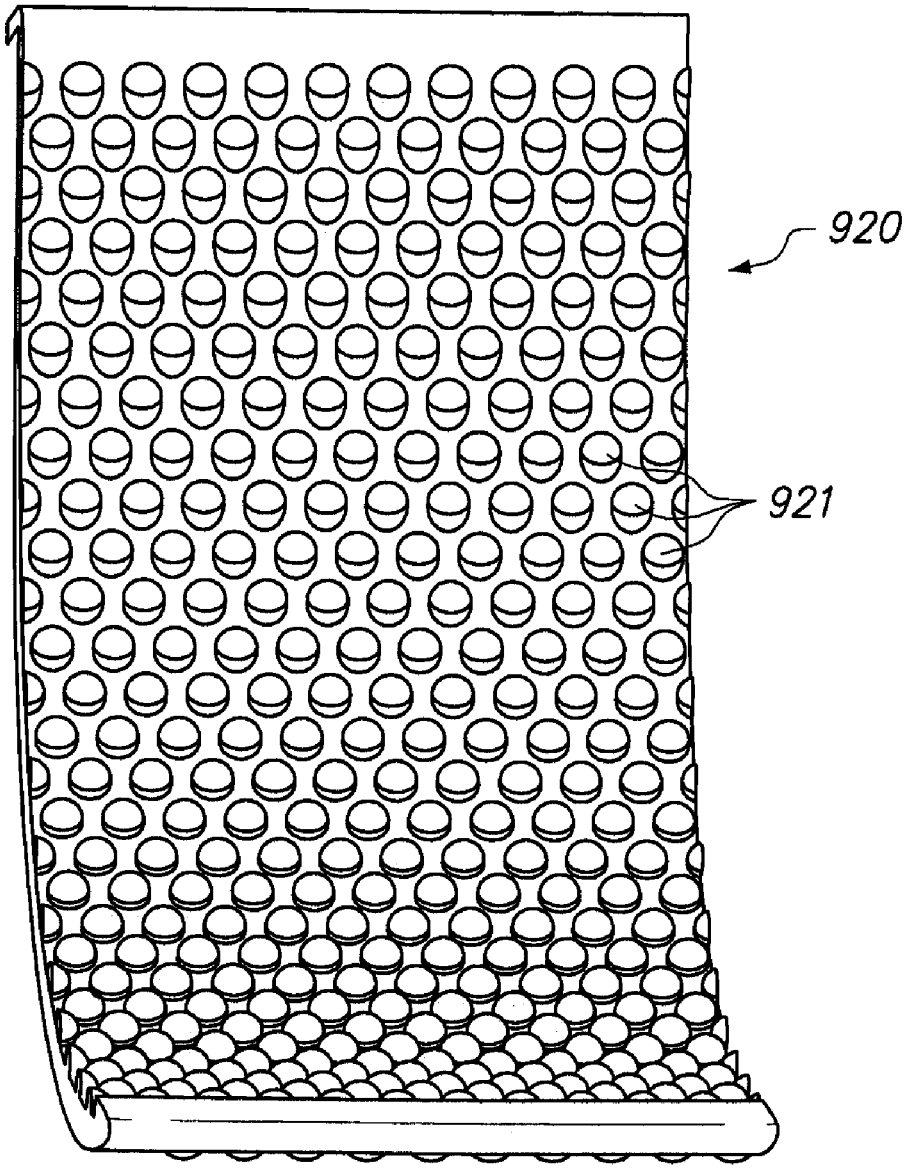

FIG. 9B shows a portion of a process shield 920 in accordance with an embodiment of the present invention. FIG. 9B shows the dimples 921 formed on the inner surface of the process shield 920. Only some of the dimples 921 are labeled for clarify of illustration.

FIG. 9B is an example where each dimple 921 is at an angle less than 90 degrees relative to the normal plane of the inner surface of the process shield 920. In the example of FIG. 9B, each dimple 921 is at a 45 degree angle relative to the normal plane of the inner surface of the process shield 920. The dimples 921 may be imparted by a mandrel 202B having a textured pattern comprising indentations (e.g., indentations 801). The number and location of the dimples 921 may vary depending on the number and locations of corresponding indentations on the contact surface of the mandrel 202B.

Figure 9C:
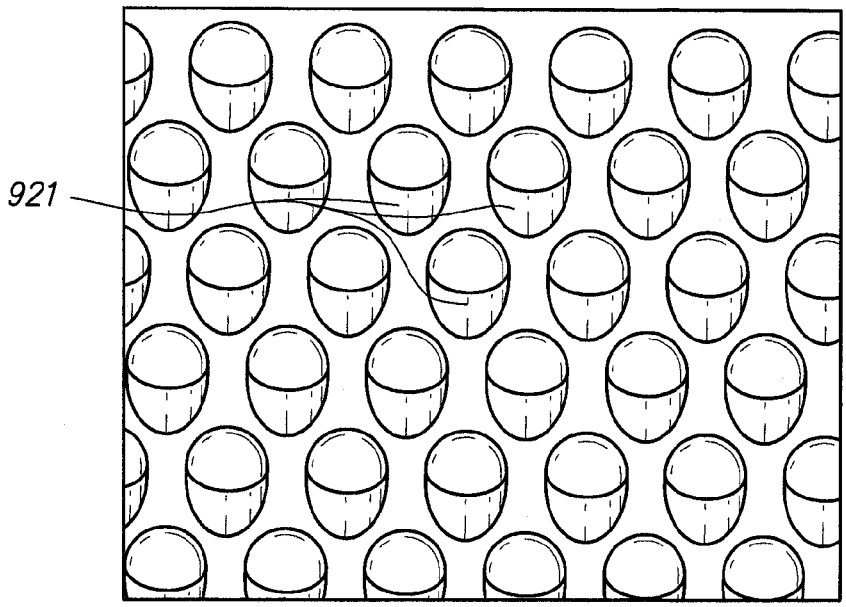

FIG. 9C shows a magnified view of the process shield 920, showing the dimples 921.

Figure 10:
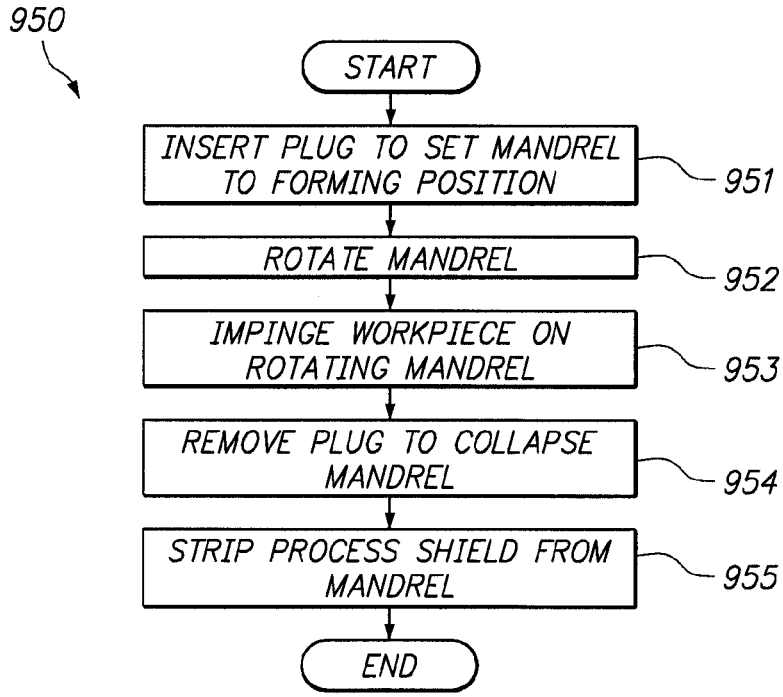
FIG. 10 shows a flow diagram of a method of operating a mandrel to form a process shield, in accordance with an embodiment of the present invention.

FIG. 10 shows a flow diagram of a method 950 of operating the mandrel 202B to form a process shield, in accordance with an embodiment of the present invention.

In preparation for the forming process, the tapered plug 700 is retracted into the mandrel 202B to set and lock the mandrel into forming position (step 951). Retraction of the plug 700 into the mandrel 202B expands the primary jaws 601 (i.e., jaws 601-2, 601-4, 601-6, and 601-8) to allow the secondary jaws 601 (i.e., jaws 601-2, 601-4, 601-6, and 601-8) to move up. Full retraction of the plug 700 into the mandrel 202B collapses the primary jaws 601 onto the secondary jaws 601, creating a forming die. The mandrel 202B is then rotated (step 952).

A workpiece (e.g., see process shield 701 of FIG. 6) is then impinged on the rotating mandrel (step 953). This may be performed by positioning the workpiece with the mandrel and clamped with a tailstock (e.g., tailstock 703 of FIG. 6). Impinging the workpiece on the rotating mandrel 202B in the same fashion as depicted by rollers 204 in FIG. 2 forms and textures the inner surface of the resulting process shield in the same forming process.

After the forming process, the plug 700 moves forward away from the mandrel 202B. This disengages the mating surface on the jaws 601, thereby allowing the collapsing of the jaws 601 and freeing the process shield 701 from the mandrel 202B without having to take apart or cut portions of the finished process shield. The process shield may be stripped from the mandrel 202B at this point (step 955).

Methods and apparatus for forming and texturing process shields and similar parts for semiconductor processing equipment have been disclosed. While specific embodiments of the present invention have been provided, it is to be understood that these embodiments are for illustration purposes and not limiting. Many additional embodiments will be apparent to persons of ordinary skill in the art reading this disclosure.

What is claimed is:

1. A method of forming a process shield of a semiconductor processing equipment, the method comprising:

providing a mandrel having a plurality of movable portions;

setting the movable portions of the mandrel into a forming die for a forming process;

rotating the mandrel;

impinging a work piece over the rotating mandrel to form the work piece into a tubular process shield of a semiconductor processing equipment and impinging hollow cavities that are at an angle of 45 degrees relative to an axis of revolution of the mandrel to an inner surface of the process shield in the same forming process; and actuating the movable portions of the mandrel to collapse the mandrel and release the process shield after the forming process.

2. The method of claim 1 wherein the semiconductor processing equipment comprises a physical vapor deposition system.

3. The method of claim 1 wherein setting the movable portions of the mandrel into a forming die comprises:

locking movable jaws of the mandrel for rotation to form the workpiece into the process shield.

4. The method of claim 3 further comprising:

collapsing the movable jaws to remove the process shield from the mandrel.

5. The method of claim 1 wherein impinging the workpiece over the rotating mandrel comprises:

contacting a textured shoe of the mandrel with the inner surface of the process shield to texture the inner surface of the process shield.

6. The method of claim 1 wherein setting the movable portions of the mandrel into the forming die comprises:

positioning a plug into the mandrel to expand the movable portions.

7. The method of claim 1 wherein actuating the movable portion of the mandrel to collapse the mandrel and release the process shield after the forming process comprises:

moving a plug within the mandrel to retract the movable portions.

8. A mandrel for forming a process shield of a semiconductor manufacturing equipment, the mandrel comprising:

a plurality of movable portions configurable to be set into a forming die position to form a workpiece into a process shield of a semiconductor manufacturing equipment and to be collapsed to allow the process shield to be stripped from the mandrel; and a textured surface on the movable portions, the textured surface being configured to contact the workpiece to impart texture thereon such that the process shield includes a textured inner surface oriented towards a substrate in the semiconductor processing equipment, the textured surface comprising hollow cavities that are at an angle of 45 degrees relative to an axis of revolution of the mandrel.

9. The mandrel of claim 8 wherein the semiconductor processing equipment comprises a physical vapor deposition system.

10. The mandrel of claim 8 wherein the plurality of movable portions comprise a set of primary jaws and a set of secondary jaws, the set of primary jaws being configurable to expand to allow the set of secondary jaws to move up and lock with the set of primary jaws to form a forming die and to collapse to allow the set of secondary jaws to retract and allow the process shield to be stripped from the mandrel.

11. The mandrel of claim 8 wherein the textured surface comprises a plurality of textured portions formed on each of the movable portions.

12. The mandrel of claim 8 wherein the mandrel is configured to accept a plug to expand the movable portions into the forming die position.

13. The mandrel of claim 8 wherein the plurality of movable portions comprises jaws each having a tapered surface and configured to accept a tapered plug.

14. A method of forming a part of a semiconductor processing equipment, the method comprising:

impinging a workpiece onto a rotating forming die such that the workpiece takes a shape of the forming die and thereby form a part for a semiconductor processing equipment during a forming process;

texturing an inner surface of the part during the same forming process by impinging hollow cavities that are at an angle of 45 degrees relative to an axis of revolution of the forming die to an inner surface of the part; and collapsing the forming die to allow the part to be stripped off the forming die.

15. The method of claim 14 wherein impinging the workpiece onto the rotating forming die comprises:

impinging the workpiece onto a textured surface of a rotating mandrel.

16. The method of claim 14 wherein collapsing the forming die to allow the part to be stripped off the forming die comprises:

expanding a first set of jaws of the forming die to allow a second set of jaws of the forming die to retract; and collapsing the first set of jaws after the second set of jaws has retracted.

17. The method of claim 14 wherein collapsing the forming die to allow the part to be stripped off the forming die comprises:

removing a tailstock clamp and disengaging a plug from the forming die.

* * * * *